US006329955B1

(12) United States Patent
McLean et al.

(10) Patent No.: US 6,329,955 B1
(45) Date of Patent: Dec. 11, 2001

(54) BROADBAND ANTENNA INCORPORATING BOTH ELECTRIC AND MAGNETIC DIPOLE RADIATORS

(75) Inventors: James Stuart McLean; Gentry Elizabeth Crook, both of Austin, TX (US)

(73) Assignee: TDK RF Solutions Inc., Cedar Park, TX (US)

( * ) Notice: Subject to any disclaimer, the term of this patent is extended or adjusted under 35 U.S.C. 154(b) by 0 days.

(21) Appl. No.: 09/428,220

(22) Filed: Oct. 26, 1999

Related U.S. Application Data

(60) Provisional application No. 60/105,612, filed on Oct. 26, 1998.

(51) Int. Cl.[7] ..... H01Q 11/12

(52) U.S. Cl. ..... 343/742; 343/741; 343/792.5; 343/793; 343/807

(58) Field of Search ..... 343/741, 742, 343/792.5, 897, 793, 794, 802, 803, 807, 745, 749, 752

(56) References Cited

U.S. PATENT DOCUMENTS

| | | | | |
|---|---|---|---|---|
| 3,721,990 | * | 3/1973 | Gibson et al. | 343/726 |
| 4,506,267 | | 3/1985 | Harmuth | 343/744 |
| 4,647,281 | * | 3/1987 | Carr | 604/50 |
| 5,926,150 | | 7/1999 | McLean et al. | 343/846 |
| 5,945,962 | * | 8/1999 | Harrington et al. | 343/792.5 |
| 6,054,963 | * | 4/2000 | Muterspaugh | 343/741 |
| 6,057,805 | * | 5/2000 | Harrington | 343/792.5 |

* cited by examiner

*Primary Examiner*—Tho Phan
(74) *Attorney, Agent, or Firm*—Darby & Darby

(57) ABSTRACT

A broadband antenna incorporating both electric and magnetic dipole radiators includes a tapered feed, such as a bow-tie feed, having a central feedpoint and first and second outer regions displaced from the central feedpoint. One or more conducting loop elements are connected between the outer regions of the tapered feed. Top loading capacitive elements extending from each of the outer regions may also be provided.

23 Claims, 8 Drawing Sheets

BROADBAND ANTENNA INCORPORATING BOTH ELECTRIC AND MAGNETIC DIPOLE RADIATORS

CROSS REFERENCE TO RELATED APPLICATIONS

This application claims priority from U.S. Provisional Patent Application Serial No. 60/105,612, filed Oct. 26, 1998, and entitled "Broadband Antenna Incorporating Both Electric and Magnetic Dipole Radiators."

FIELD OF THE INVENTION

The present invention relates generally to the field of broadband, reduced-size antennas for use in, e.g., HF and VHF communications, electromagnetic compatibility testing, electronic warfare, and ultrawideband and ground penetrating RADAR.

BACKGROUND OF THE INVENTION

For most applications, including both communications and electromagnetic compatibility testing, it is generally desirable for antennas to be as small as possible for reasons of convenience, durability, and aesthetics. In the case of military communications, it is also often necessary for antennas to exhibit low observability (LO). In the HF (3–30 MHz) and VHF (30–300 MHz) bands for which wavelengths are on the order of meters to tens of meters, it is thus necessary to utilize electrically-small antennas, that is, antennas with geometrical dimensions which are small compared to the wavelengths of the electromagnetic fields they radiate. Quantitatively, electrically-small antennas are generally defined as antennas which fit inside a so-called radiansphere, that is a sphere with a radius, $r=\lambda/2\pi$, where $\lambda$ is the wavelength of the electromagnetic energy radiated.

Electrically-small antennas exhibit large radiation quality factors Q; that is, they store (on time average) much more energy than they radiate. This leads to input impedances which are predominantly reactive, and, as a result, the antennas can be impedance-matched only over narrow bandwidths. Furthermore, because of the large radiation quality factors, the presence of even small resistive losses leads to very low radiation efficiencies. According to known quantitative predictions of the limits on the radiation Q of electrically small antennas, the minimum attainable radiation Q for any linearly polarized antenna which fits inside a spherical volume of radius a can be computed exactly, according to the equation:

$$Q = \frac{1}{ka} + \frac{1}{k^3a^3} \qquad \text{(Equ. 1)}$$

where $k=1/\lambda$, the wavenumber associated with the electromagnetic radiation. The available theories can be succinctly summarized by stating that the radiation Q of an electrically small antenna is roughly proportional to the inverse of its electrical volume. Furthermore, the radiation Q is essentially inversely proportional to the antenna bandwidth. Therefore, in order to achieve relatively broad bandwidth and high efficiency with a single-element electrically-small antenna of a given size, it is necessary to utilize as much as possible of the entire volume that an antenna occupies.

In order to achieve an antenna having this fundamental limit on radiation Q given in Equation 1, an antenna would have to excite only the $TM_{01}$ or $TE_{01}$ mode outside the enclosing spherical surface and store no electric or magnetic energy inside the spherical surface. So while, a Hertzian (short) dipole excites the $TM_{01}$ mode, it does not satisfy the criterion of storing no energy within the sphere and thus will exhibit a higher radiation Q (and hence narrower bandwidth) than that predicted by Equation 1.

In general, all antennas which radiate dipolar fields, such as wire dipoles and loops, are limited by the constraint given in Equation 1. Some broadband dipole designs have been successfully implemented and approach the limit given in Equation 1. However, it is not possible to construct a linearly-polarized, isotropic antenna which exhibits a radiation Q less than that predicted by Equation 1.

While Equation 1 represents the fundamental limit on the radiation Q for a linearly polarized, omni-directional antenna, it is not the global lower limit on radiation Q. Instead, an antenna which radiates equal power into the $TM_{01}$ and $TE_{01}$ modes can (in principle) achieve a radiation Q of:

$$Q = \frac{1}{2}\left[\frac{1}{(ka)^3} + \frac{2}{ka}\right] \qquad \text{(Equ. 2)}$$

A quality factor for an antenna which meets this characteristic is roughly half of that of an antenna which radiates only $TM_{01}$ or $TE_{01}$, alone. As a result, the attainable impedance bandwidth of the antenna is nearly doubled. While an equipartition of radiated power in the two modes is required to achieve the radiation Q given in Equation 2, the polarization state and radiation pattern of the modes do not need to match, and instead can take on different forms depending on the relative phases and orientations of the modes. Although prior analysis has been performed on a very general class of antennas with equal electric and magnetic multipole moments, no specific antenna designs having these characteristics have been presented.

Ideal antennas having a pair of infinitesimally small, co-located, electric and magnetic dipoles oriented to provide orthogonal dipole moments have been theoretically and numerically examined previously and found to provide several useful features. Examples of such ideal antennas 10, 20 are shown in FIGS. 1 and 2. The antennas 10, 20 include an infinitesimal magnetic dipole loop 11, 21 with an associated feed 12, 22 and an infinitesimal electric (wire) dipole 13, 23 with an associated feed 14, 24. As can be appreciated, because the antenna elements are infinitesimally small, the shape of the loop is not crucial. Thus, the square loop 21 in FIG. 2 functions essentially equivalently to the circular loop 11 in FIG. 1.

For the theoretically-examined co-located pair antenna described above, the electric field, in the far field region, is given by the equations:

$$E_\theta\left[\frac{A}{\eta}\sin\theta + B\sin\phi\right]\frac{e^{-jkr}}{r}, \text{ and} \qquad \text{(Equ. 3)}$$

$$E\phi = B[\cos\theta\cos\phi]\frac{e^{-jkr}}{r} \qquad \text{(Equ. 4)}$$

where A and B are weighting coefficients of the $TM_{01}$ and $TE_{11}$ modes respectively, and r, $\theta$, and $\phi$ constitute a standard right-hand spherical coordinate system. If $A=\eta B$ then the directional gain of the antenna is given by the equation:

$$G(\theta, \phi) = \frac{3[(\sin\theta + \sin\phi)^2 + \cos^2\theta\cos^2\phi]}{4} \quad \text{(Equ. 5)}$$

and cardioid patterns with linear polarization are provided in the θ=90 plane and the ϕ=90 plane. FIG. 3 is a graph of the farfield gain pattern. As can be seen, a maximum gain of $G_{max}$=3.0 (4.77 dBi) is achieved at θ=90 and ϕ=90.

However, if A=jηB, the directional gain is:

$$G(\theta, \phi) = \frac{3[(\sin\theta)^2 + (\sin\phi)^2]}{4} \quad \text{(Equ. 6)}$$

The farfield gain pattern of such an antenna is depicted in FIG. 4. The maximum gain still occurs at θ=90. However, for this configuration, the maximum gain value $_{Gmax}$ is now only 1.5 (1.77 dBi). Therefore, as can be appreciated by one of skill in the art, the combination of an electric and a magnetic dipole with proper orientation, amplitude ratio, and relative phase results in a radiator with roughly half the radiation Q and as much as 3 dB more gain than an isolated dipole.

Another useful aspect of including both electric and magnetic dipole modes in an antenna is that the maximum power output (as limited by electric field breakdown in the nearfield) is improved. It can be seen physically and has been shown mathmatically, that, for purposes of producing maximum radiated power before electric field breakdown in the nearfield, the TE (magnetic multipole) modes and in particular, the $TE_{01}$ mode are better. This is because the nearfield energy is magnetic as opposed to electric. Thus any admixture of TE modes is an improvement over a simple dipole antenna.

Previous work in this area has been limited primarily to theoretical and numerical investigations of co-located pairs of infinitesimal electric and magnetic dipoles (as well as ensembles of higher-order multipoles). While, as discussed above, the co-located pair of infinitesimal electric and magnetic dipoles has been shown to possess many valuable attributes, it is not a practical radiator. First, co-location is impossible when finite-sized elements are used. Furthermore, unless the elements have some appreciable electrical size, while still remaining electrically-small, broad band operation is impossible. Therefore, for an antenna to achieve multi-octave bandwidths, it is necessary for it to be electrically-small at the lower end of its operating frequency range, but only slightly so. In other words, the enclosing spherical surface has a radius of approximately λ/2π. This requirement is in stark contrast to "infinitesimally" small radiators having a radius on the order of λ/100.

In addition, the feed network for the electric and magnetic dipole combination is difficult to implement. Although possible feed networks have been previously suggested, none of the presently known designs suggest operate effectively over a broad frequency range. Thus, use of these designs negates any improvements in bandwidth provided by the lower radiation Q of the radiator.

In order to provide broadband operation, it is necessary that the relative amplitudes and phases of the electric and magnetic dipole radiation be maintained over the operating frequency range to within some finite tolerance. Having done this it is necessary to effectively impedance match the resulting antenna system to RF source. This is a particularly difficult problem due to the resonant nature of the combined electric and magnetic dipole radiator. To date, while extensive analyses extolling the desirable characteristics of idealized radiators combining electric and magnetic dipole radiation have been published, no practical systems have been implemented.

Accordingly, it would be advantageous to provide a practical antenna design which combines electric and magnetic dipole radiators to provide an antenna with a small quality factor Q.

It would be further advantageous if such an antenna had a broad bandwidth of operation and, in particular, maintained modal amplitude and phase matching of the electric and magnetic radiation as well as impedance matching over a wide range of frequencies.

SUMMARY OF THE INVENTION

According to the invention, a novel antenna design is presented which includes a broadband, electrically-small radiating element containing an electric dipole and a magnetic loop dipole oriented so that their dipole moments are orthogonal. A physical connection is provided between the electric and magnetic dipoles, which connection is displaced from the feed point of the antenna. By physically connecting a broadband electric dipole and a broadband loop much broader bandwidth is achieved than can be provided by a wire dipole and loop combination. In a particular embodiment, the antenna comprises a capacitively loaded bow-tie dipole antenna coupled to a dual-loop structure which is attached near the outer corners of the bow-tie dipole and operates in conjunction with the bow-tie dipole to form a magnetic dipole antenna. The new antenna configuration combines electric and magnetic dipole radiators in a single package and solves the above mentioned problems concerning maintaining modal amplitudes and phases as well as impedance matching.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 5:
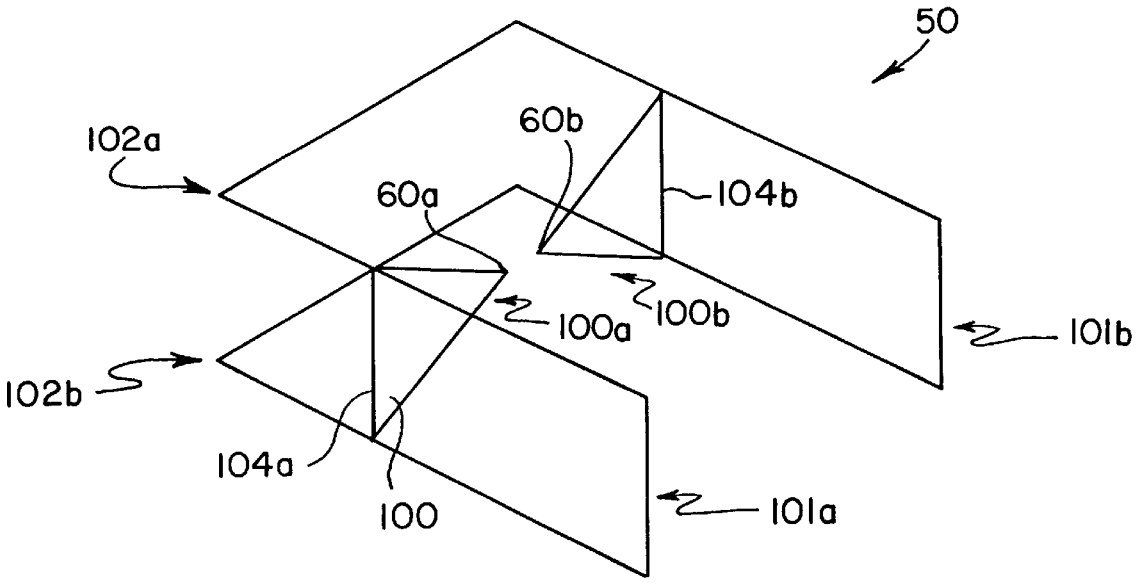
FIG. 5 is an illustration of an antenna according to the invention which incorporates electric and magnetic dipole radiation.
Figure 6:
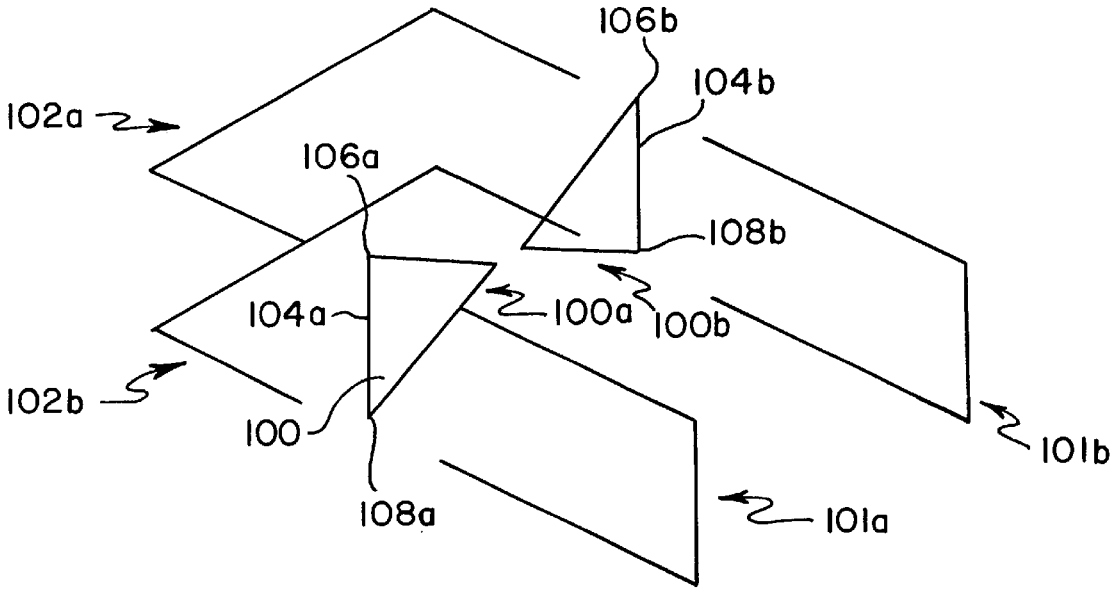
FIG. 6 is an exploded view of the antenna of FIG. 5.

Turning now to FIG. 5, there is shown a compact broadband antenna 50 according to the invention which combines electric and magnetic dipole radiators. The construction of the antenna 50 may be more clearly understood using the exploded view of FIG. 6. Referring to FIGS. 5 and 6, the antenna 50 comprises a bow-tie dipole or tapered feed element 100 and illustrated here as a pair of triangular elements 100*a*, 100*b* lying in the same plane. The bow-tie dipole 100 has a pair of central feeds 60*a*, 60*b*. The use of a tapered geometry greatly enhances radiation at the higher end of the operating range of the antenna 50. Although a planar, triangular bow-tie structure 100 is disclosed, it is understood that biconical or other tapered antenna elements may be used instead and the terms bow-tie and tapered feed will be used interchangeably throughout the following discussion.

Preferably, a pair of parallel U-shaped elements 101*a*, 101*b* extend substantially perpendicularly from the respective ends 104*a*, 104*b* of the bow-tie dipole 100 and provide top hat or capacitive loading of the bow-tie element 101 in order to lower its fundamental resonance and hence enhance its performance at the lower end of its opening frequency range. The pair of parallel elements 101*a*, 101*b* together with the bow-tie dipole 100 generally form a tapered inverted-L dipole antenna. In addition, a pair of loops 102*a*, 102*b* are attached generally between the top outer comers 106*a*, 106*b* and bottom outer corners 108*a*, 108*b*, respectively, of bow-tie dipole 100. Preferably, as illustrated, the loops 102*a*, 102*b* are parallel to each other and extend from the bow-tie 100 in an opposite direction from the capacitive loading conductors 101*a*, 101*b*.

Figure 1:
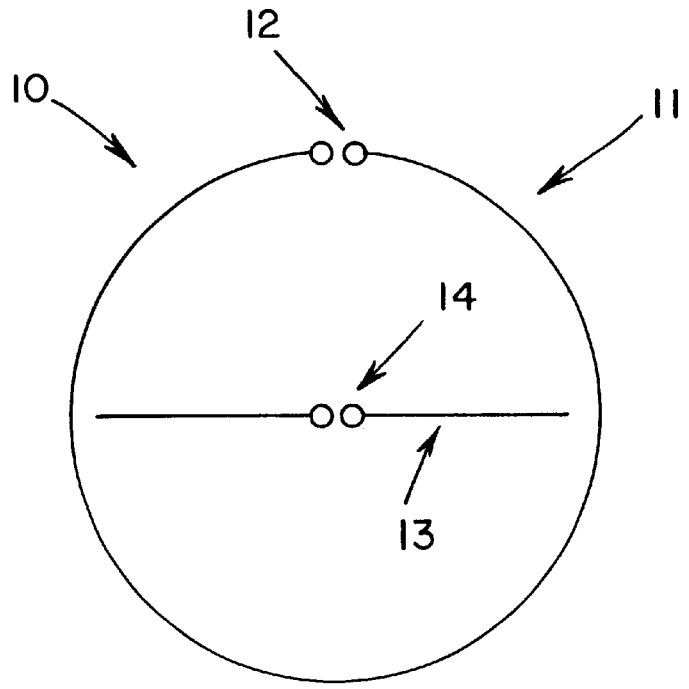
FIG. 1 PRIOR ART
FIGS. 1 and 2 are illustrations a conventional co-located infinitesimal electric and magnetic dipole pairs.
Figure 2:
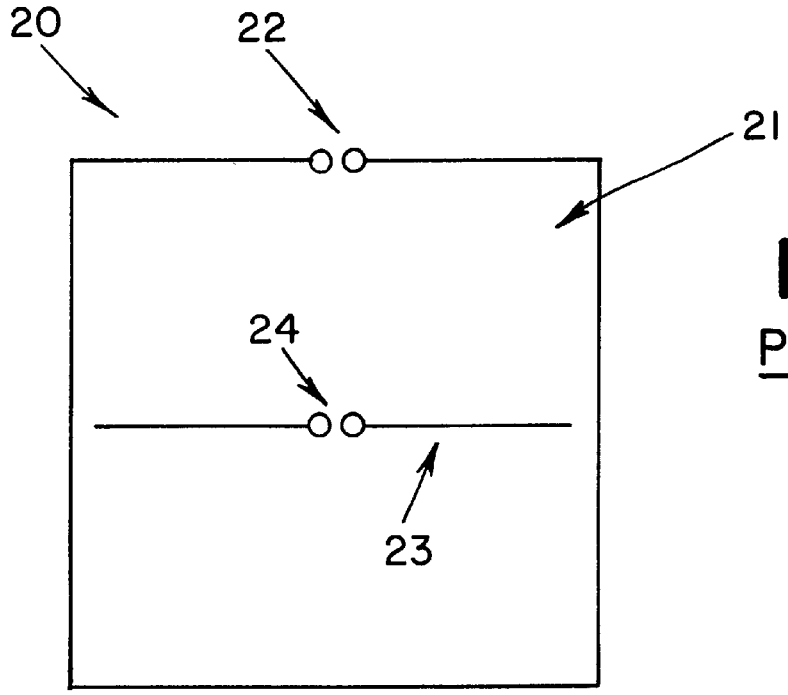
FIG. 2 PRIOR ART
Figure 3:
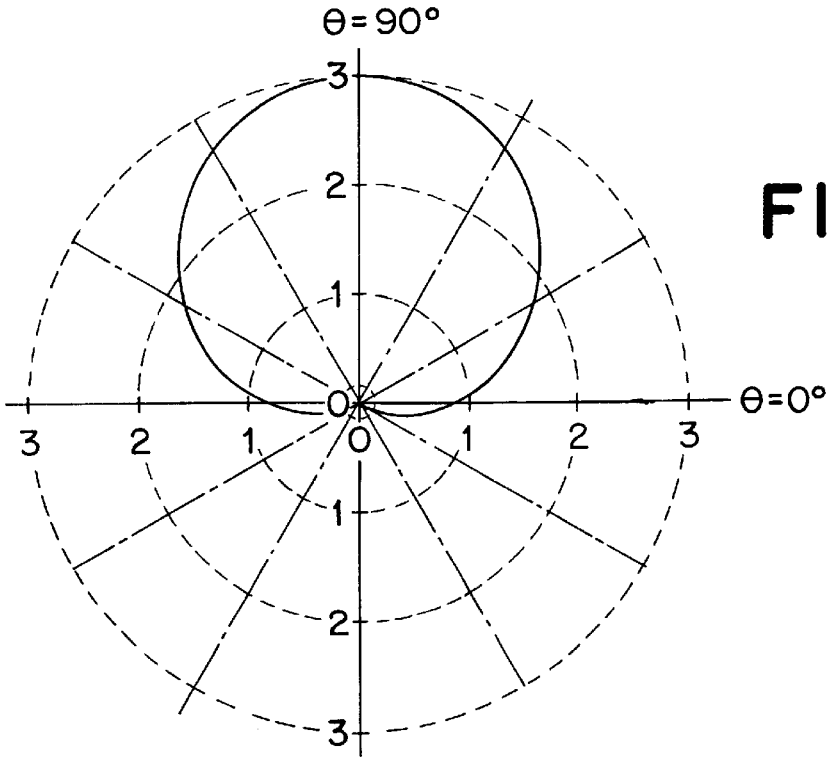
FIG. 3 is a graph of the cardioid elevation pattern produced by an electric and magnetic dipole pair when equipartition of power is maintained and modal phase is 90 degrees.
Figure 4:
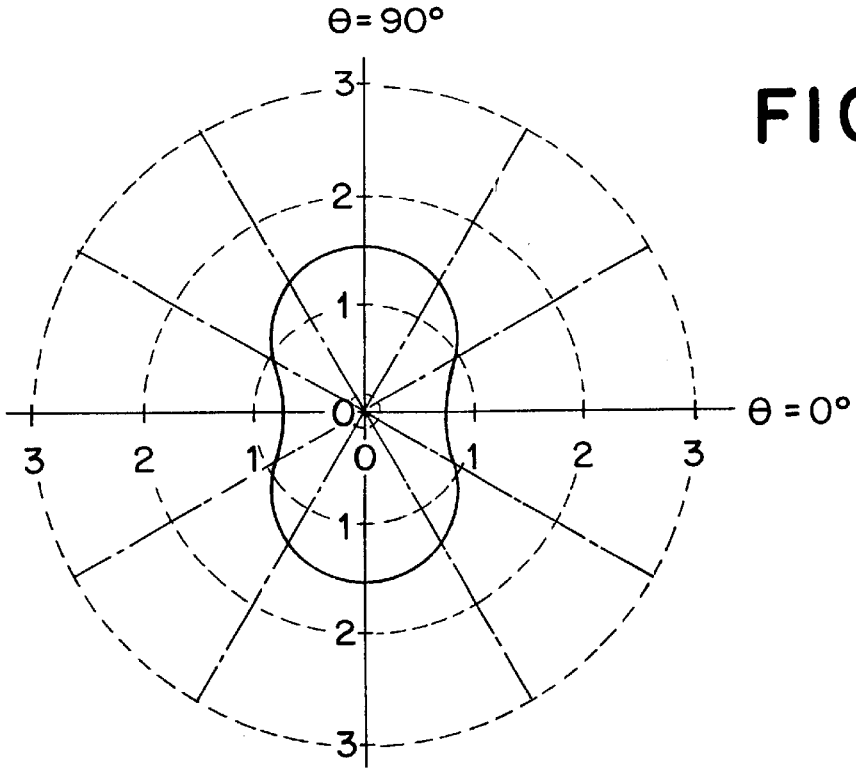
FIG. 4 is a graph of the elevation pattern produced by an electric and magnetic dipole pair when equipartition of power is maintained but modal phase is zero degrees.
Figure 7:
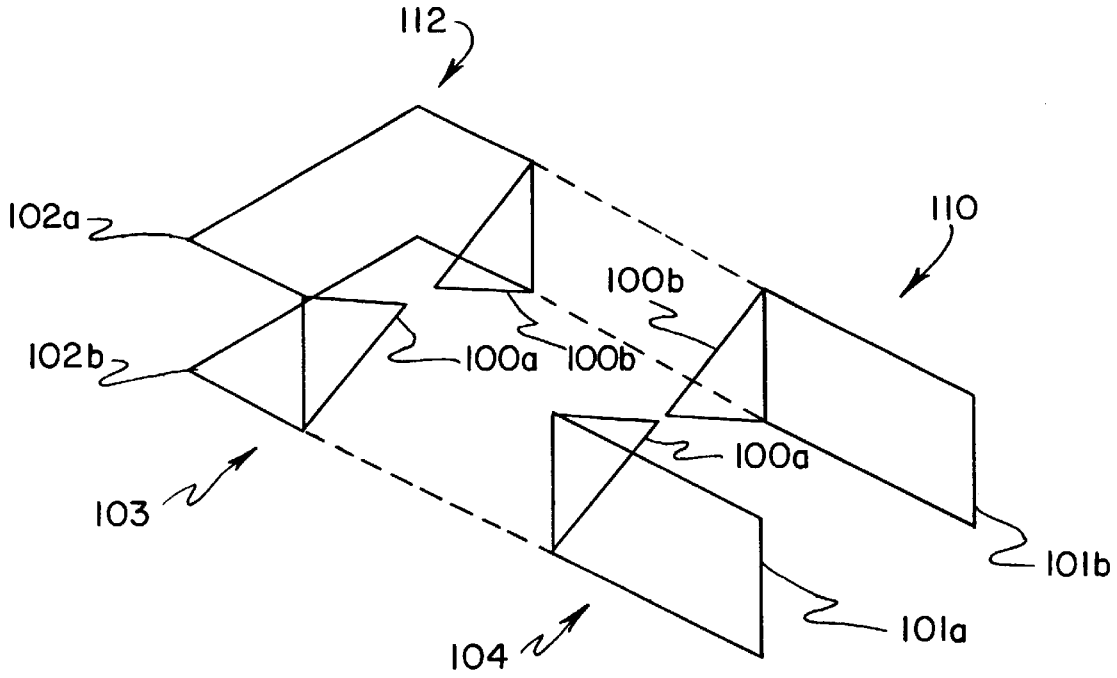
FIG. 7 is an illustration of the magnetic and electric dipole components of the antenna of FIG. 5.

FIG. 7 is an illustration of the magnetic and electric dipole components of the antenna formed by the antenna of FIG. 5. For clarity, the bow-tie element 100 is illustrated twice. As shown, an electric dipole antenna 110 is formed by the capacitively loaded bow-tie 100. In addition, the loops 102*a*, 102*b* operate in conjunction with the bow-tie dipole 100 to form a magnetic dipole 112. The electric and magnetic dipoles 110, 112 are merged in the antenna of FIG. 5 and are analogous to the idealized co-located electric and magnetic dipoles in FIGS. 1 and 2. However, unlike the idealized infinitesimal dipoles examined in theory, the antenna of the invention is a physically practical form.

The elements comprising the antenna embodiment 50 of FIG. 5 generally take the form of conductive frames. The conductive frames may be formed from any conductive material or combination of materials which may be shaped to form the elements shown. In a preferred embodiment, the conductive material is aluminum. In this and other embodiments of the antenna 50 recited herein, the various antenna elements may also be formed from conductive mesh, conductive sheets, or a combination thereof. In addition, it is understood that when a conductive mesh or sheet is used to form a section of the antenna, the frame for that section need not be conducting, although the use of a conducting frame is preferred.

Figure 8:
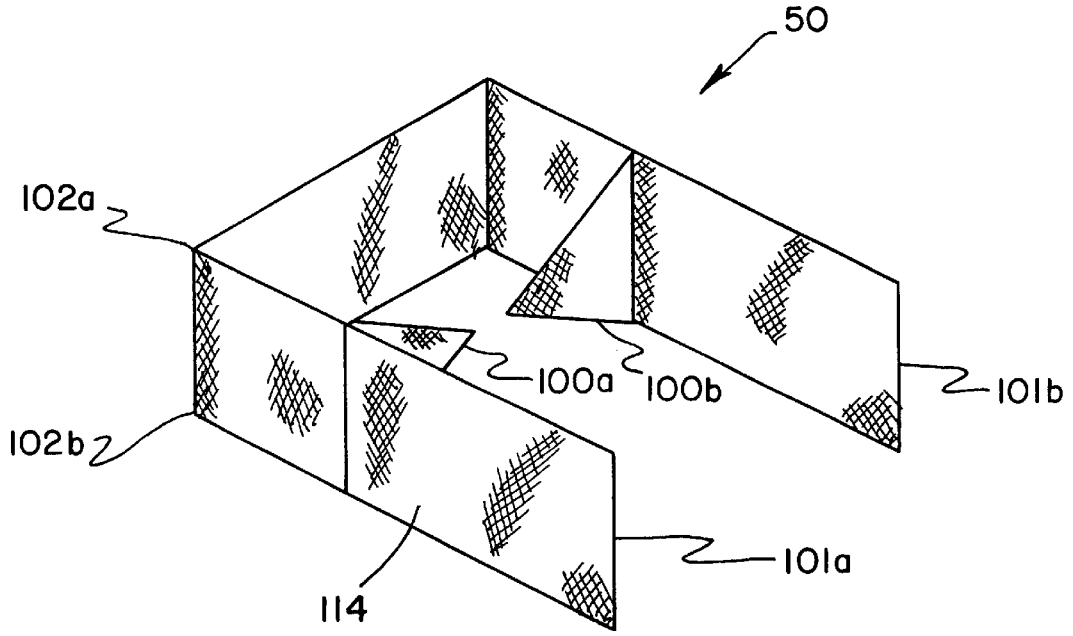
FIG. 8 is an illustration of the antenna of FIG. 5 formed using conductive sheet or mesh.
Figure 9:
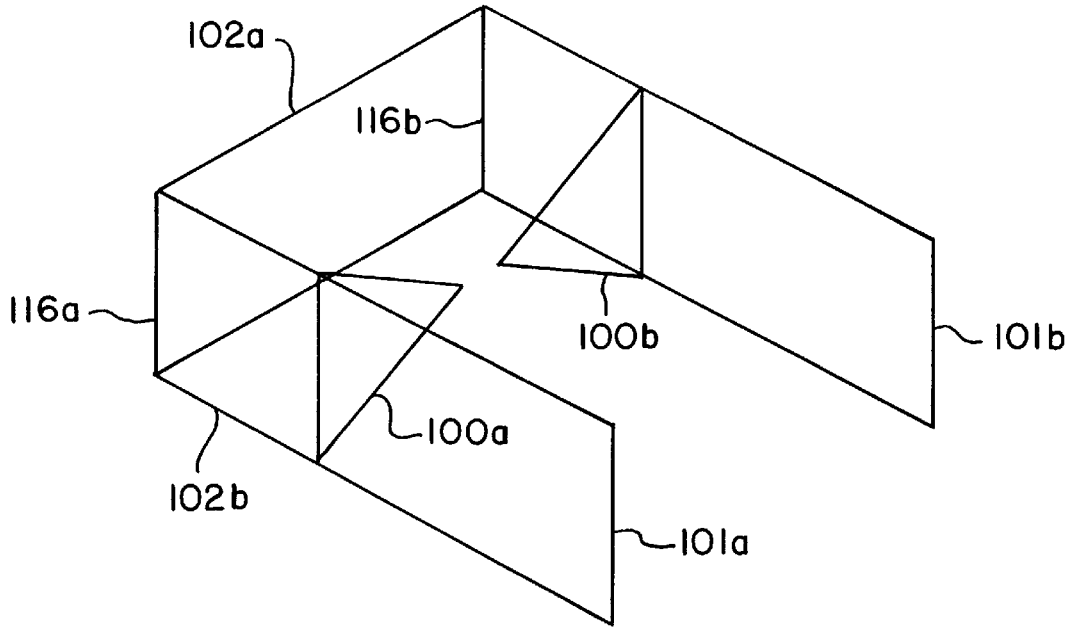
FIG. 9 is an illustration of the antenna of FIG. 5, further including interior support elements.
Figure 10:
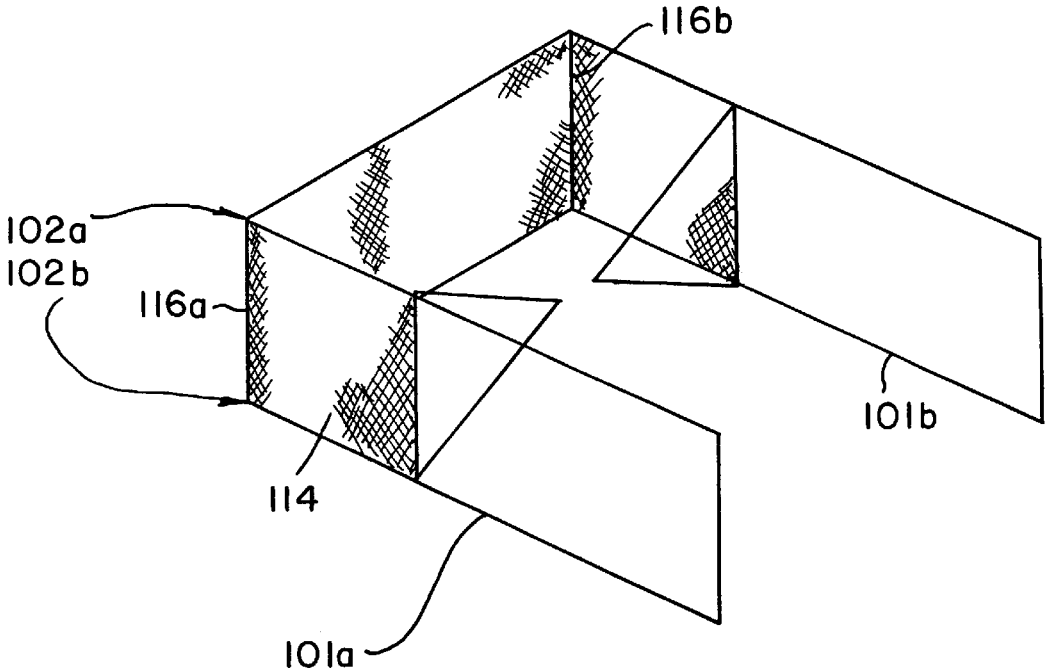
FIG. 10 is an illustration of the antenna of FIG. 9 formed using a combination of conductive frames and conductive sheet or mesh.

For example, and with reference to FIG. 8, conductive sheet or mesh 114 may be used to "fill in" one or more of (a) the triangles formed by tapered feed elements 100*a*, 100*b*, (b) the rectangles formed by capacitive loading elements 101*a*, 101*b*, and (c) the area between the loops 102*a*, 102*b*. In embodiments of the antenna 50 which have conductive frames elements, the frames may contain interior elements which may be conductive or non-conductive. For example, FIG. 9 illustrates an embodiment of antenna 50 having interior support elements 116*a*, 116*b* placed between the magnetic loop elements 102*a*, 102*b*. FIG. 10 illustrates the antenna of FIG. 9 having conductive frame elements and further including a conductive mesh or sheet 114 only between the loop portions 102*a*, 102*b*.

Figure 11:
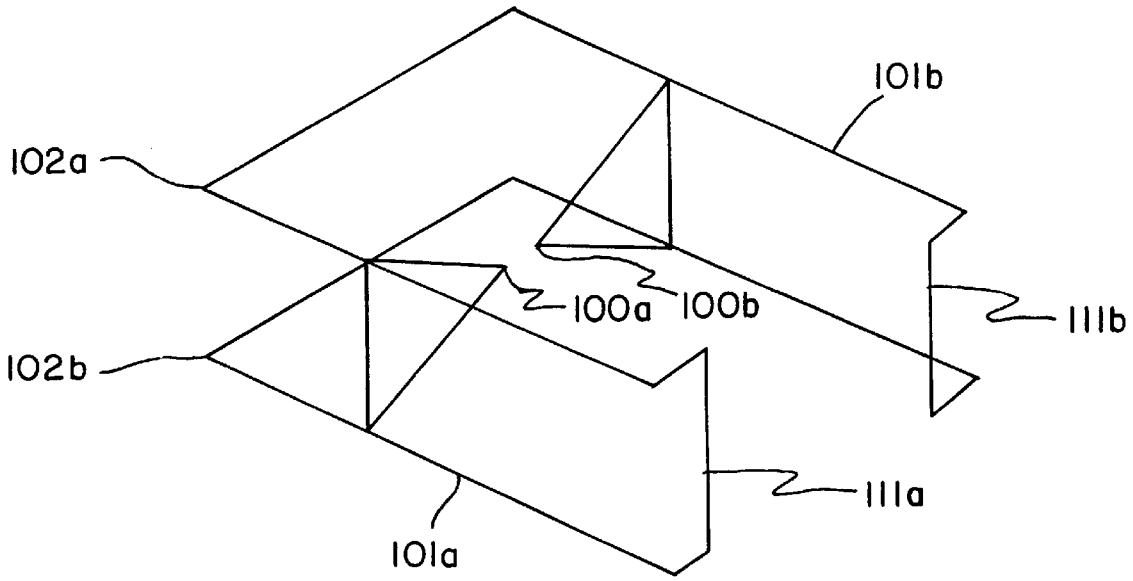
FIG. 11 is an illustration of the antenna of FIG. 5 including L-shaped top loading elements.
Figure 12:
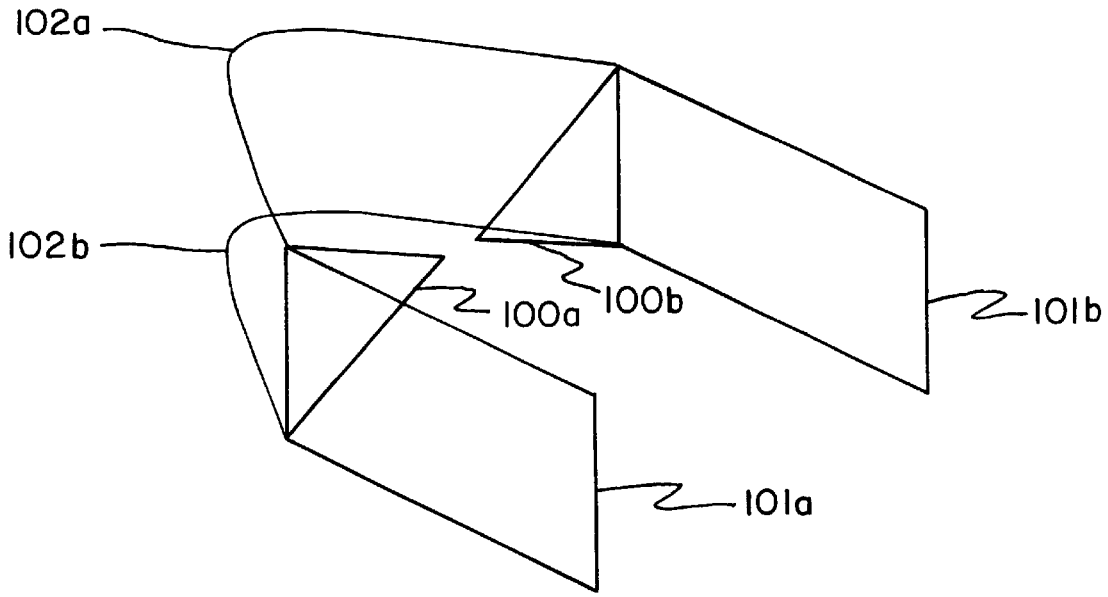
FIG. 12 is an illustration of the antenna of FIG. 5 including curved loop elements.

Various combinations of frames, mesh, and/or conductive sheets may be used to form an antenna according to the invention. The specific combinations used are dependent on design aspects, such as various mechanical design considerations. In addition, because of the electrically-small nature of the antenna 50, the exact shapes of the component elements are not critical. For example, the capacitive loading plates 101*a*, 101*b* need not be exactly parallel to each other. Nor do they need to be exactly rectangular, but can have other regular or irregular shapes. Thus, as shown in FIG. 11, the ends 111*a*, 111*b* of the loading plates 101*a*, 101*b* may be bent inwards, forming a pair of L-shaped elements having increased loading capacitance. The shape of the loop elements 102*a*, 102*b* can also be distorted with minimal impact on the performance of the antenna. For example, as shown in FIG. 12, loop elements 102*a*, 102*b* may be curved, rather than U-shaped.

In addition, the connection points of the pair of loops 102*a*, 102*b* to the bow-tie element can be moved closer together vertically along the opposed ends 104*a*, 104*b* such that the separation between the loops is reduced. It should be noted, that while parallel loop elements are preferred, the elements need not be parallel to each other and can also be tilted with respect to the horizontal plane. Further, the connection points of each of the loop elements to the bow-tie feed 100 can be moved inwards along the tapered edges of elements 100*a*, 100*b*, respectively, toward the feed points 60*a*, 60*b*, such that the connecting ends of the loop elements are closer together, resulting in a "tighter" loop. Preferably, the connections of the loops to the bow-tie feed 100 are displaced from the feed points 60*a*, 60*b* at least an electrically significant amount. Such a displacement modifies the input impedance of the antenna in such a way as to reduce the overall impedance level, especially in the vicinity of the first and second parallel resonances.

Figure 13:
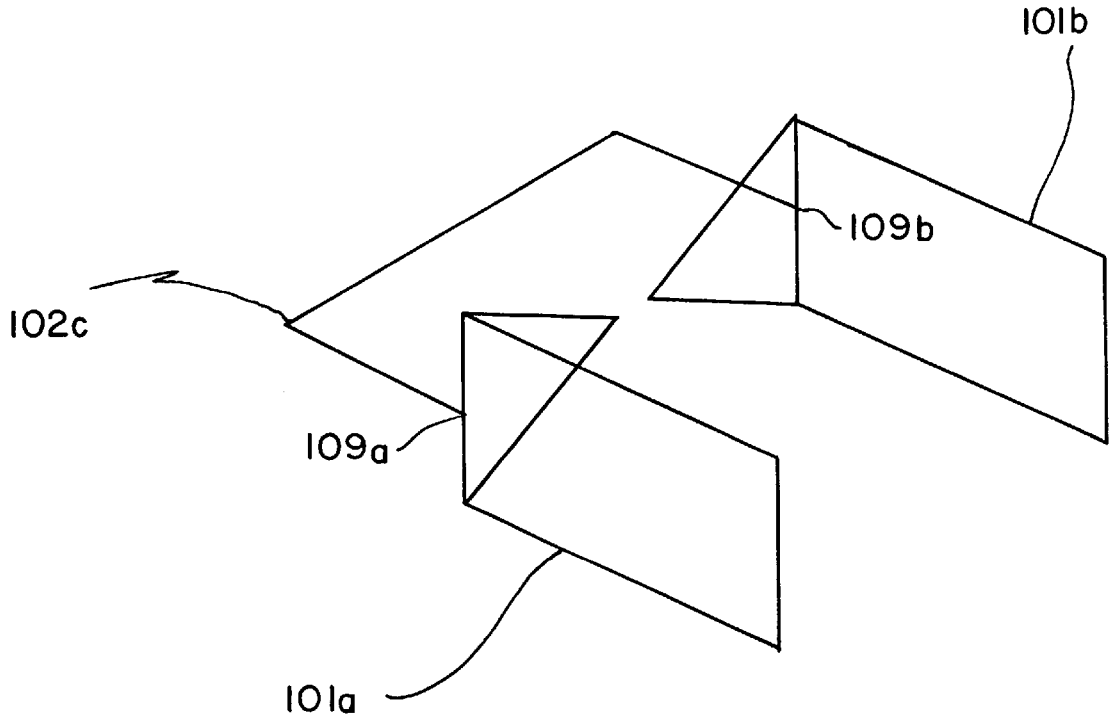
FIG. 13 is an illustration of an antenna according to a second embodiment of the invention which incorporates electric and magnetic dipole radiation.

While the antenna 50 has been discussed above as having a pair of loop elements 102*a*, 102*b*, preferably attached between the top and bottom outer comers of the bow-tie element, as discussed, the loops need not be connected to the outermost comers of feed elements 100. Further, the number of loops may be varied, from a single loop to multiple loops. As shown in FIG. 13, a single loop 102*c* is connected between elements 100*a* and 100*b* at points 109*a*, 109*b*. The position of the connection points 109*a*, 109*b* can vary in a manner similar to that discussed above with respect to a dual loop embodiment. Although this design may be somewhat lighter and more compact than embodiments for which the loop portion has a height comparable to that of the bow-tie feed element 100, i.e., as achieved by the use of two loops connecting the upper and lower corners, respectively, of the bow-tie elements 100*a*, 100*b*, such a single-loop embodiment may have a somewhat reduced bandwidth compared to those having a greater height.

In addition, as will be appreciated by those of skill in the art, if feed elements 100*a*, 100*b* are formed using conductive mesh or sheet, loop elements 102 could also connect at points within the perimeters of feed elements 100. Support elements within the interior of elements 100 may be needed to realize such a connection mechanically. Preferably, however, the loop elements are connected at or near the outermost points of the feed elements as shown and described above.

Figure 14:
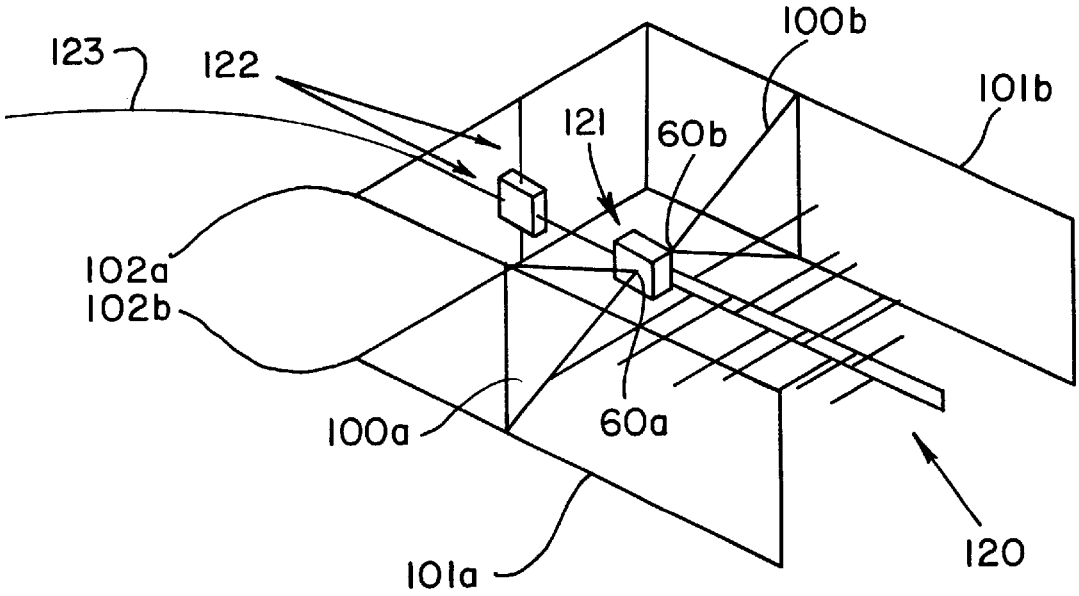
FIG. 14 is an illustration of the antenna of FIG. 5 combined with a log periodic dipole array.
Figure 15:
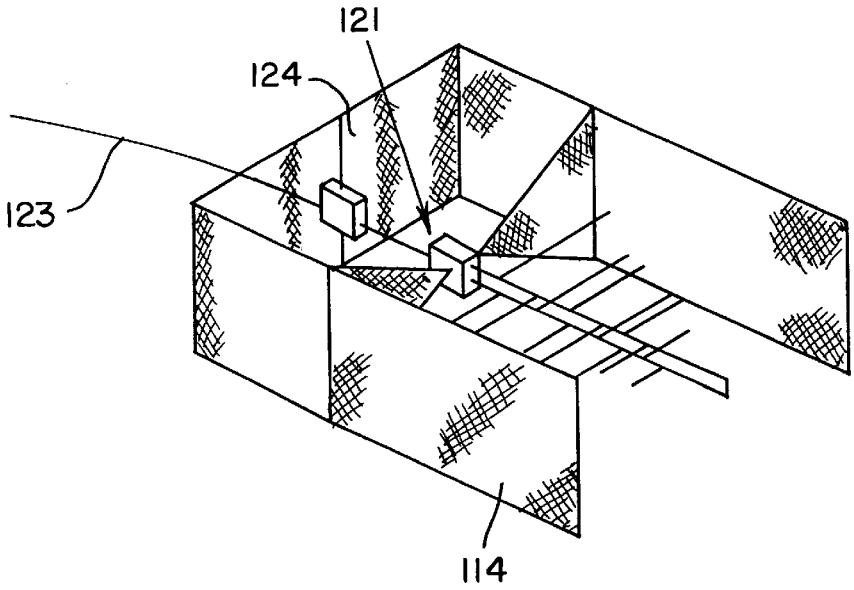
FIG. 15 is an illustration of the antenna of FIG. 14 formed using conductive sheet or mesh.

The broadband antenna 50 described above can be combined with a log periodic dipole array (LPDA) 120 to produce a very broadband directional antenna. Hybrid combinations of LPDAs and broadband, electrically-small radiating elements (such as a bowtie or biconical dipole) are sometimes constructed in order to augment the performance of the LPDA at the lower end of its operating range. The antenna described herein is particularly useful for such a system because its directional gain (4.77 dBi) approaches that of the low-gain LPDAs often used in such hybrid systems. Such a combination is shown in FIG. 14. A balun 121 is used to connected the LDPA 120 to feeds 60*a*, 60*b* of the antenna 50. A dielectric support assembly 122 is also provided to support cable 123 used to connect to the antenna 50. FIG. 15 illustrates the hybrid antenna formed with conductive mesh, similar to the antenna embodiment illustrated in FIG. 8. To provide for a convenient feed line connection, a portion 124 of the conductive mesh or screen 114 may be removed.

Figure 16:
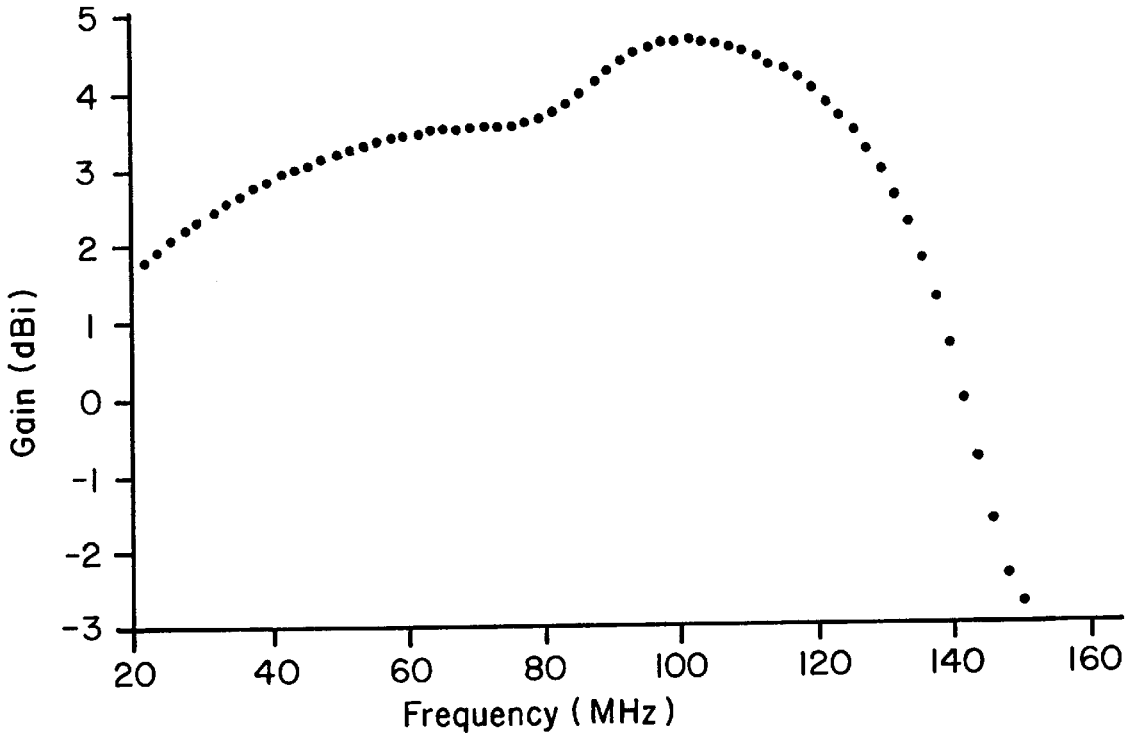
FIG. 16 is a graph of gain vs. frequency of antenna of FIG. 5.

FIG. 16 is a graph of the forward gain vs. frequency of the antenna 50 calculated using Numerical Electromagnetics Code. A conventional broadband dipole provides only 1.7–2.1 DBi of directional gain. As can be seen, the new low-frequency antenna element disclosed herein exhibits much higher forward directional gain.

It should be noted that the input impedance of the antenna 50 constructed in accordance with the invention may vary significantly over its operating frequency range. Thus, it may be advantageous to use a matching transformer at the input to the antenna. When combining the antenna with an LPDA, it is generally advantageous to place this transformer between the LPDA and the broadband element 50. The selection of a suitable matching transformer is dependent on the geometries of the specific antenna configuration at issue and other factors known to those of skill in the art.

What is claimed is:

1. A broadband antenna incorporating both electric and magnetic dipole radiators comprising:

a tapered feed having a central feedpoint and first and second outer ends displaced from the central feedpoint, said first and second outer ends extending outwardly from said central feedpoint in generally opposite directions to define the electric dipole; and at least one loop element connected between the first and second outer ends to define the magnetic dipole.

2. The antenna of claim 1, wherein said loop element comprises one of a conducting sheet or mesh.

3. The antenna of claim 1, further comprising a log periodic dipole array coupled to the feedpoint of the tapered feed.

4. The antenna of claim 1, wherein the tapered feed comprises a bow-tie feed.

5. A broadband antenna incorporating both electric and magnetic dipole radiators comprising: a tapered feed having a central feedpoint and first and second outer regions displaced from the central feedpoint, said first and second outer regions extending outwardly from said central feedpoint in generally opposite directions; and at least one loop element connected between the first and second outer regions, further comprising:

a first capacitive element connected to the first outer region and extending substantially perpendicular to the tapered feed; and a second capacitive element connected to the second outer region and extending substantially perpendicular to the tapered feed.

6. The antenna of claim 2, wherein:

the first and second outer regions have respective top and bottom corners; and said at least one loop element comprises a first conducting loop connecting the top corner of the first outer region with the top corner of the second outer region, and a second conducting loop connecting the bottom corner of the first outer region with the bottom corner of the second outer region.

7. The antenna of claim 6, wherein said first and second conducting loops are substantially U-shaped.

8. A broadband antenna incorporating both electric and magnetic dipole radiators comprising:

a bow-tie feed having a central feedpoint and first and second outer regions displaced from the central feedpoint, the first and second outer regions including respective top and bottom corners and extending outwardly from said central feedpoint in generally opposite directions;

a first capacitive element connected between the top and bottom corners of the first outer region and extending substantially perpendicular to a tapered feed;

a second capacitive element connected between the top and bottom corners of the second outer region and extending substantially perpendicular to the tapered feed and in alignment with the first capacitive element;

a first conducting loop connected between the top corner of the first outer region and the top corner of the second outer region; and a second conducting loop connected between the bottom corner of the first outer region with the bottom corner of the second outer region.

9. The antenna of claim 8, further comprising a log periodic dipole array coupled to the feedpoint of the bow-tie feed.

10. An antenna, comprising:

a magnetic dipole including a tapered feed element; and a capacitively-loaded electric dipole including the feed element, wherein the magnetic and electric dipoles are coupled together such that only the feed element is shared between them.

11. The antenna of claim 10 wherein the magnetic dipole comprises a conductor connected between the outer edges of a bow-tie feed element to form a loop.

12. The antenna of claim 11 wherein the capacitively-loaded electric dipole comprises:

a bow-tie feed element in a first plane; and a pair of top-loading elements, wherein each of the pair of top-loading elements is connected to a respective outer edge of the bow-tie feed element, such that each of the pair of top-loading elements is substantially parallel to the other of the pair of top-loading elements, and each of the pair of top-loading elements is in a second plane substantially perpendicular to the first plane.

13. The antenna of claim 11 wherein the bow-tie feed element comprises a pair of elements which have a base and an opposing apex, wherein the pair of elements is adapted for coupling of an input signal between the apexes and wherein the bases comprise the outer edges of the bow-tie feed element.

14. The antenna of claim 11 wherein said first and second conducting loops are substantially U-shaped.

15. The antenna of claim 11 wherein said loop element comprises one of a conducting sheet or mesh.

16. The antenna of claim 11, further comprising a log periodic dipole array coupled to the feedpoint of the tapered feed.

17. The antenna of claim 11 wherein the tapered feed comprises a bow-tie feed.

18. The antenna of claim 10 wherein the capacitively-loaded electric dipole comprises:

a bow-tie feed element in a first plane; and a pair of top-loading elements, wherein each of the pair of top-loading elements is connected to a respective outer edge of the bow-tie feed element, such that each of the pair of top-loading elements is substantially parallel to the other of the pair of top-loading elements, and each of the pair of top-loading elements is in a second plane substantially perpendicular to the first plane.

19. The antenna of claim 18 wherein the bow-tie feed element comprises a pair of elements which have a base and an opposing apex, wherein the pair of elements is adapted for coupling of an input signal between the apexes and wherein the bases comprise the outer edges of the bow-tie feed element.

20. The antenna of claim 10 wherein said first and second conducting loops are substantially U-shaped.

21. The antenna of claim 10 wherein said loop element comprises one of a conducting sheet or mesh.

22. The antenna of claim 10, further comprising a log periodic dipole array coupled to the feed point of the tapered feed.

23. The antenna of claim 10 wherein the tapered feed comprises a bow-tie feed.

* * * * *